US007325612B2

(12) United States Patent
Hendrickson et al.

(10) Patent No.: US 7,325,612 B2
(45) Date of Patent: Feb. 5, 2008

(54) ONE-TRIP CUT-TO-RELEASE APPARATUS AND METHOD

(75) Inventors: James D. Hendrickson, Sugar Land, TX (US); Bennie Gill, Fulshire, TX (US); Reginald E. Francis, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 317 days.

(21) Appl. No.: 10/908,136

(22) Filed: Apr. 28, 2005

(65) Prior Publication Data

US 2006/0243445 A1 Nov. 2, 2006

(51) Int. Cl.
*E21B 43/11* (2006.01)
*E21B 33/12* (2006.01)

(52) U.S. Cl. ..... 166/298; 166/297; 166/361; 166/55; 166/63

(58) Field of Classification Search ..... 166/63, 166/55, 55.1, 361, 297, 298
See application file for complete search history.

(56) References Cited

U.S. PATENT DOCUMENTS

| | | | | |
|---|---|---|---|---|
| 2,934,147 | A * | 4/1960 | Baker | 166/63 |
| 5,054,555 | A * | 10/1991 | Lalande et al. | 166/298 |
| 5,720,343 | A | 2/1998 | Kilgore et al. | |
| 5,810,083 | A * | 9/1998 | Kilgore | 166/120 |
| 6,478,093 | B1 * | 11/2002 | Hilts et al. | 166/387 |
| 6,702,031 | B2 * | 3/2004 | Doane et al. | 166/382 |
| 6,789,627 | B2 | 9/2004 | Leismer | |
| 6,860,901 | B1 | 3/2005 | Baker | |
| 6,868,848 | B2 | 3/2005 | Boland | |
| 7,178,598 | B2 * | 2/2007 | Lund et al. | 166/298 |
| 2005/0006102 | A1 | 1/2005 | Cho | |

FOREIGN PATENT DOCUMENTS

| | | | |
|---|---|---|---|
| GB | 2372767 | A | 9/2002 |
| GB | 2407337 | A | 4/2005 |
| WO | 2002029203 | A1 | 4/2002 |
| WO | 2003093624 | A3 | 11/2003 |
| WO | WO 03/104608 | A1 | 12/2003 |

* cited by examiner

*Primary Examiner*—William Neuder
*Assistant Examiner*—Nicole A Coy
(74) *Attorney, Agent, or Firm*—Osha-Liang LLP; Dona C. Edwards; Bryan P. Galloway

(57) ABSTRACT

Apparatuses and methods allow a downhole anchor device to be cut, released, and retrieved using a single one-trip cutter and removal assembly. The assembly preferably includes a cutter head recessed behind an anchor latch. The latch is landed to the anchor device to be removed and the cutter head is extended therefrom and activated. Once cut by the cutter head, the anchor device is retrieved upon a distal end of the assembly.

24 Claims, 7 Drawing Sheets

ONE-TRIP CUT-TO-RELEASE APPARATUS AND METHOD

BACKGROUND OF THE INVENTION

Packers are installed in petroleum industry wellbores to isolate adjacent zones or regions from one another. Particularly, packers are used in petroleum production installations to isolate the annulus between a string of production tubing and a cased borehole to prevent the unwanted escape of production fluids.

Packers typically function by expanding one or more elastomeric packer elements to fill any gaps between the production tube (or a through bore of the packer) and the wellbore (either cased or open). The packer element can be expanded either by "inflating" the elastomeric elements with pressurized fluid or by upsetting flexible elements through axial compression. Additionally, packers may also include anchor devices to "bite" into the tubing or wellbore in which they are to be set. Slips of the anchor mechanism are often set and ratcheted in place to prevent the packer from displacing axially up or down the bore once it is set. Irrespective of construction or the deployment method used, packers effectively create fluid seals between an inner tubular member and an outer tubular member.

Furthermore, packers can be constructed to be either retrievable or permanent. Retrievable packers are preferably constructed so they can be set or retrieved into or out of a borehole with special tools and procedures. In contrast, permanent packers are not so easily retrieved. Because of their design and intent for long-term emplacement, most "permanent" packers must be destructively cut to release them from the location in which they are installed. This cutting operation typically severs mechanical devices that engage the bore to make the packer's engagement therewith permanent. Because slips of packer anchors are typically configured with one-way ratchet profiles, they cannot be easily released once engaged. As such, a cutting operation will be undertaken to cut and disengage the slips of the anchor mechanism so the packer assembly can be retrieved.

Currently, operations to remove a permanent packer or anchor involve running of a cutter assembly downhole to the location of the device to be cut. Next, a chemical or mechanical cutter head is activated and severs the critical components of the device to be released. The cutter assembly is then retrieved (leaving the crippled packer or anchor behind) so that a retrieving, or fishing, apparatus could be run into the hole to remove the severed packer assembly. Because a minimum of two trips downhole is required, an operation using this procedure can take considerable time and cause significant delays in downhole operations. Furthermore, because the cut packer is left in place while the cutter assembly is retrieved from and the fishing assembly is run into the hole, there is a chance the packer can fall deeper into the wellbore. As such, it is desirable that the cutting operations to retrieve packers and other anchor components to run as quickly as possible. Any apparatus or methods to improve cutting and retrieval operations for anchored downhole components would be well received in the industry.

SUMMARY OF THE INVENTION

The deficiencies of the prior art are addressed by an apparatus to cut and release a downhole anchor. The apparatus preferably includes a housing deployed upon a string of tubing in a well bore, wherein the housing includes an engagement adapter at its distal end. The apparatus preferably includes a cutter assembly in a recessed position within the distal end of the housing. Preferably, the engagement adapter corresponds with an engagement profile of the downhole anchor. Preferably, the cutter assembly is configured to extend longitudinally from the recessed position to an extended position when the string of tubing is axially loaded. Preferably, the cutter assembly is configured to cut and release the downhole anchor when activated in the extended position. Preferably, the engagement adapter is configured to retain the downhole anchor and retrieve it from the well bore after the cutter assembly is activated. Preferably, the cutter assembly is positioned below the housing when in the extended position.

The deficiencies of the prior art are also addressed in part by a method to remove an anchor device from a wellbore. The method preferably includes deploying a string of tubing down the wellbore to the anchor device, wherein the string of tubing has a housing having an engagement adapter and a recessed cutter at a distal end thereof The method preferably includes engaging the engagement adapter within an engagement profile of the anchor device. The method preferably includes extending the recessed cutter longitudinally below the housing. The method preferably includes activating the extended cutter and cutting the anchor device with the activated cutter. The method preferably includes retrieving the string of tubing from the well bore to remove the cut anchor device attached thereto.

The deficiencies of the prior art are also addressed in part by a cut and release tool to retrieve an engaged downhole anchor. The cut and release tool preferably includes a main body disposed at a distal end of a string of tubing disposed within a wellbore. The cut and release tool preferably includes an explosive cutter recessed within the string of tubing and within the main body and an engagement adapter connected to the main body and configured to securely engage with a corresponding profile of the downhole anchor. Preferably, the cutter is configured to longitudinally extend from a recessed position to an extended position when the string of tubing is axially loaded. Preferably, the explosive cutter is positioned below the main body when in the extended position. Preferably, the cutter is configured to cut and release the downhole anchor when detonated. Preferably, the threaded adapter is configured to retain the downhole anchor and retrieve it from the well bore after the cutter is detonated.

DETAILED DESCRIPTION OF THE PREFERRED EMBODIMENTS

Figure 1A:
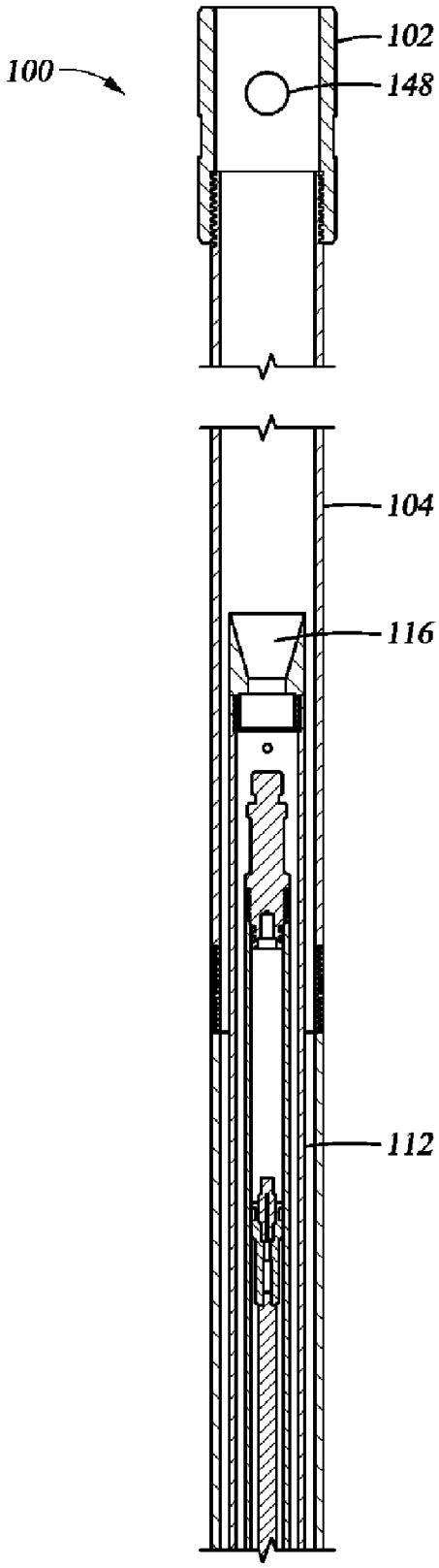
FIG. 1 A-D is a schematic section-view drawing of a one-trip cut to release tool in accordance with an embodiment of the present invention.
Figure 1B:
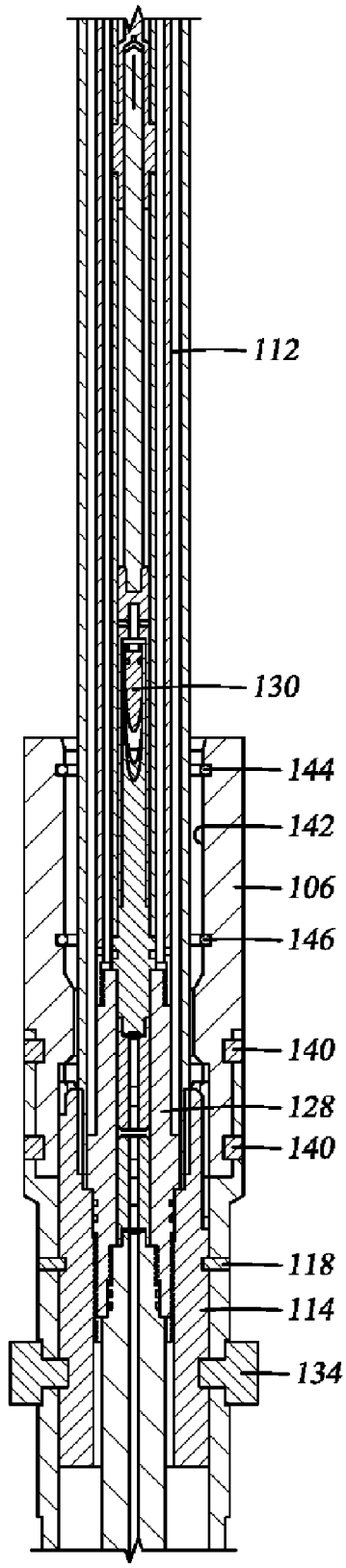
Figure 1C:
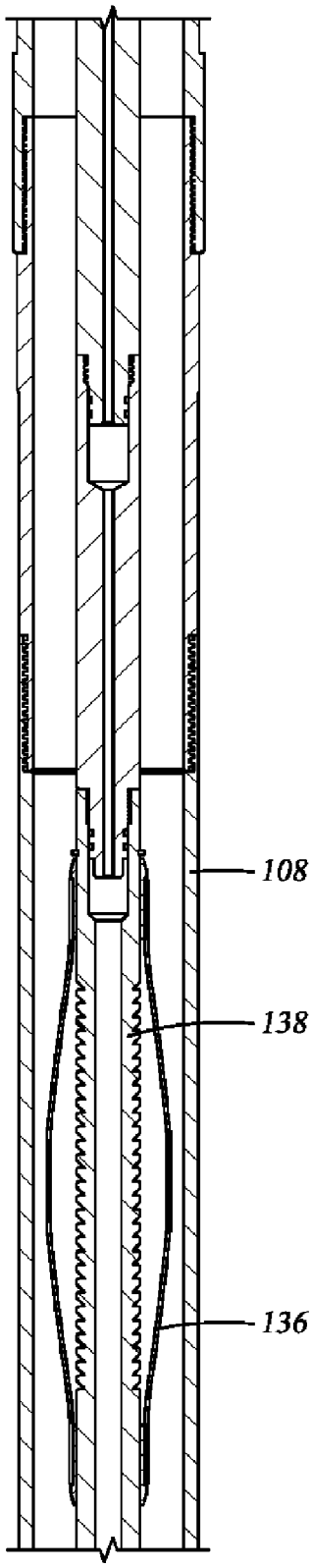
Figure 1D:
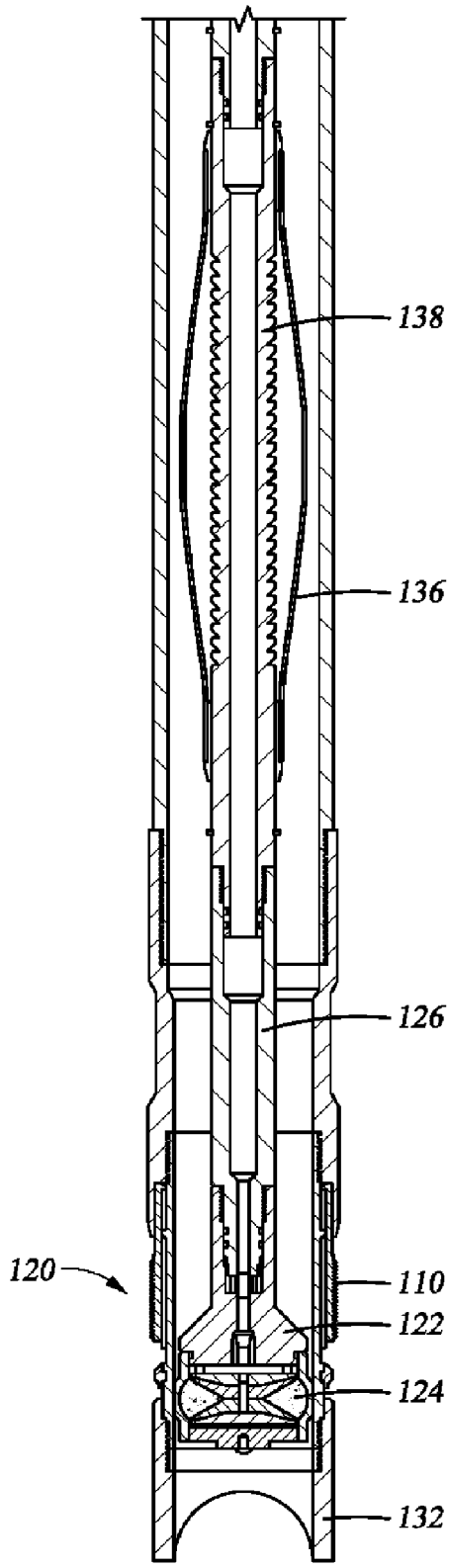

Referring to FIG. 1, a one-trip cut to release tool assembly 100 capable of severing and retrieving a downhole anchor device is shown. While the term downhole anchor is used throughout this description, it should be understood that a downhole anchor could be any device installed downhole in such a way as to isolate a region, position or orient tools, or otherwise restrict access to a portion of the borehole. Therefore, the term "downhole anchor" includes, but is not limited to, packers, anchors, bore plugs, whipstocks, and muleshoes. Furthermore, while this disclosure is directed to the retrieval of "permanent" anchor devices, i.e. those that require a destructive cutting or severing operation to be removed, it should be understood that the present invention might include the cutting and releasing of "retrievable" anchor devices as well.

Cut to release tool 100 is preferably deployed downhole upon a distal end of a string of tubing (not shown) and connected at coupling 102. A string of thrust tubing 104 connects coupling to a main body 106 of cut to release tool assembly 100. A lower string of tubing 108 extends from main body 106 to an engagement adapter 110 that is configured to engage within a corresponding engagement profile of a downhole packer or anchor. An internal string of activation tubing 112 extends from within thrust tubing 104 to main body 106, terminating at a sliding mandrel 114. A hydraulic inlet 116 allows fluid from inside thrust tubing 104 to communicate with activation tubing 112. Optionally, a hydraulic line (not shown) can extend from a surface station to hydraulic inlet 116 through the bore of thrust tubing 104 to allow more direct control of cut to release tool 100. Activation tubing 112 and mandrel 114 are preferably configured to be slidably engaged within lower tubing 108 when shear screws 118 are ruptured and thrust tubing 104 is thrust downward.

A hydraulically activated cutter assembly 120 is connected to activation tubing 112 at a distal end of mandrel 114. Cutter assembly 120 includes a cutter head 122 carrying a shape charge 124 capable of severing a downhole anchor, a downhole packer, or any other downhole well tool. Shape charge 124 is preferably configured to be hydraulically detonated but can be detonated through any means known in the art. While a shape charge detonation cutter 120 is shown, it should be understood that other types of cutters 120 including hydraulic cutters and chemical cutters, may be used. A thick-walled line 126 extends from cutter head 122 through tubing 108 to a union 128 with activation tubing 112. To activate and fire shape charge 124 of cutter head 122, hydraulic pressure is increased in activation tubing 112 through hydraulic inlet 116 until a detonation device 130 is activated and sends a detonation shock to shape charge 124 through thick walled line 126.

To release an emplaced downhole anchor or packer, the one trip cut to release assembly 100 is deployed and activated to sever components that maintain a grip on the inner wall of the bore in which the device is retained. Cut to release assembly 100 is deployed upon the distal end of a string of tubing connected at coupling 102. The string of tubing can be a string of drill pipe, coiled tubing, slickline, or any other structural conduit capable of transmitting axial loads and hydraulic pressure downhole. Furthermore, safety plugs 134 prevent any premature detonation of cutter head 122 while cut to release tool 100 is on the rig floor or before it is run downhole. Therefore, safety plugs 134 must be removed prior to running cut to release assembly 100 downhole.

Cut to release assembly 100 is run downhole until adapter 110 engages within a corresponding profile of the device to be cut. Preferably, the engagement profile is located above the point of severance to ensure the one-trip cut to release assembly 100 is not damaged by the detonation. With one-trip cut to release assembly 100 engaged within the device to be cut, cutter assembly 120 is extended and detonated. Cutter assembly 120 is delivered downhole in a retracted (shown) position to prevent premature detonation of shape charge 124 from contact with downhole components. Furthermore, a shroud 132 below engagement adapter 110 protects firing head 122 from incidental damage and provides a portal through which cutter assembly 120 extends.

Before cutter assembly 120 can be extended beyond shroud 132 and detonated, shear screws 118 must first be ruptured. Shear screws 118 retain mandrel 114 within main body 106 and thereby prevent the extension of cutter assembly 120. Each shear screw 118 is preferably designed as a screw or pin manufactured out of a material having known shear strength. With the shear strength known, the cross-sectional area of each shear screw 118 can be sized such that screws 118 will rupture and allow relative movement between mandrel 114 and main body 106 when a pre-defined tension load limit is exceeded. Shear screws 118 shown in FIG. 1 are preferably designed to rupture when thrust tubing 104 is pulled up with a predetermined amount (e.g. 30,000 pounds) of axial tension.

Once shear screws 118 are ruptured, tubing 104 is thrust downward to extend cutter assembly 120 downhole through shroud 132 and clear of engagement adapter 110. Thrust tubing 104 is preferably designed to have a downward stroke equal to the distance cutter head 122 is required to be extended below shroud 132. Because each anchor device to be cut will have a unique "weak point" where it is to be severed, the stroke of thrust tubing 104 is preferably selected such that cutter head 122 is positioned adjacent to that weak point when thrust tubing 104 is fully displaced. Bow springs 136 are engaged through ratchet profiles 138 of thick-walled hydraulic line 126 to stabilize and hold cutter assembly 120 in position once cutter head 122 is extended and detonated.

Furthermore, when thrust tubing 104 is fully displaced, coupling 102 is seated within a sealing profile 142 at a distal end of main body 106. Sealing profile 142 provides a pair of hydraulic seals 144, 146, so that a hydraulic port 148 of coupling 102 is no longer exposed. Prior to full displacement of tubing 104 and engagement of coupling 102 into profile 142, hydraulic port 148 acts as a safety measure to prevent the build up of hydraulic pressure within bore of thrust tubing 104 or hydraulic tubing 112. When coupling 102 is not sealed within profile 142, any build up of pressure in bore of tubing strings 104 and 112 is released through port 148. Because detonation device 130 is pressure activated, port 148 assists in preventing the premature firing of cutter assembly 120. With thrust tubing 104 fully displaced, port 148 of coupling 102 is isolated by seals 144 and 146 so pressure within hydraulic tubing 112 is allowed to increase.

When cutter head 122 is properly aligned with an anchor device and coupling 102 seated within profile 142, hydraulic pressure is increased within tubing 112 until detonation device 130 is activated. Once activated, detonation device 130 transmits energy to detonate shape charge 124 of cutting head 122 and sever the critical components of the anchor device. Detonation can be instant or delayed, depending on the particular configuration of detonation device 130. Furthermore, detonation device 130 can be constructed to detonate shape charge 124 through electrical, hydraulic, mechanical, or shock energy once activated. Additionally, detonation device 130 can be omitted and an electrical line extended to firing head 122 through bore of tubing 104 from the surface, if desired.

If firing head is properly aligned within the downhole anchor device when fired, the anchor device should be released from engagement with the wellbore and can be retrieved upon the distal end of one-trip cut to release assembly 100. Engagement adapter 110 is preferably configured to retain engagement of the downhole anchor device after detonation so the device can be severed and retrieved in a single trip downhole. In the event cutting head 122 does not sever the downhole anchor device completely, one-trip cut to release assembly 100 can be configured to be released from the anchor device and retrieved from the wellbore, allowing for a second attempt to be made.

Alternatively, one-trip cut to release assembly 100 can be constructed to allow a second detonation. Shear screws 140 holding main body 106 and lower string of tubing 108 together can be sheared through increased axial tension to allow a new cutter assembly 120 to be delivered and fired. This arrangement is particularly useful when engagement adapter 110 and corresponding profile of the downhole anchor is not easily separated. Particularly, it is important that the rupture shear strength of screws 140 is higher than that of screws 118 to prevent accidental separation of lower tubing 108 from main body 106 when attempting to release mandrel 114 as mentioned above. A replacement cutter assembly 120 can be constructed such that anchor device is severed at a different location than before. Preferably, the replacement cutter assembly 120 engages main body 106 or lower tubing 108 in such a way as to allow the anchor device to be retrieved after a successful firing.

Figure 2A:
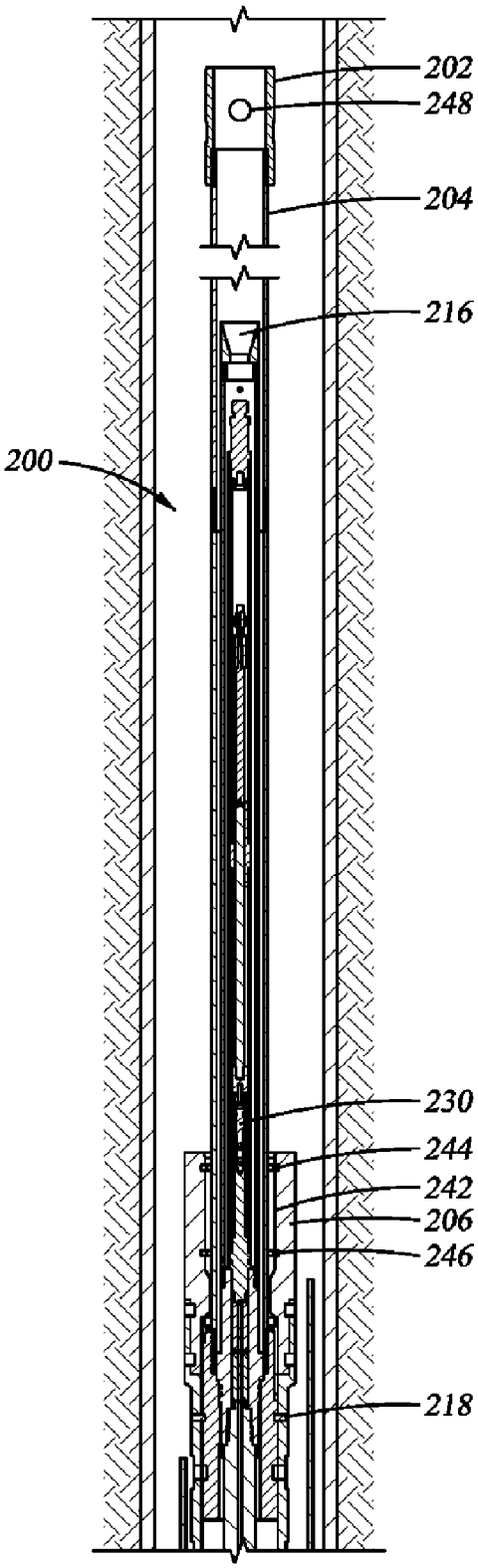
FIG. 2 A-E is a schematic section-view drawing of a one-trip cut to release tool having a retracted cutting head and engaged within a downhole packer in accordance with an embodiment of the present invention.
Figure 3A:
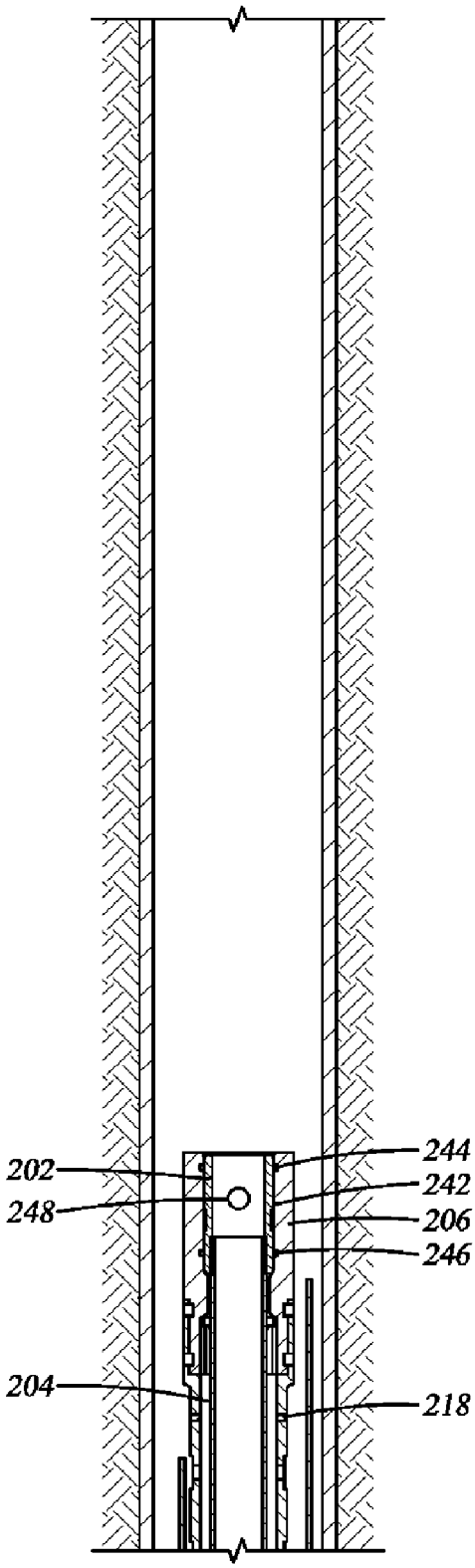
FIG. 3 A-E is a schematic section-view drawing of the one-trip cut to release tool of FIG. 2 engaged within a downhole packer wherein the cutting head is extended.
Figure 2B:
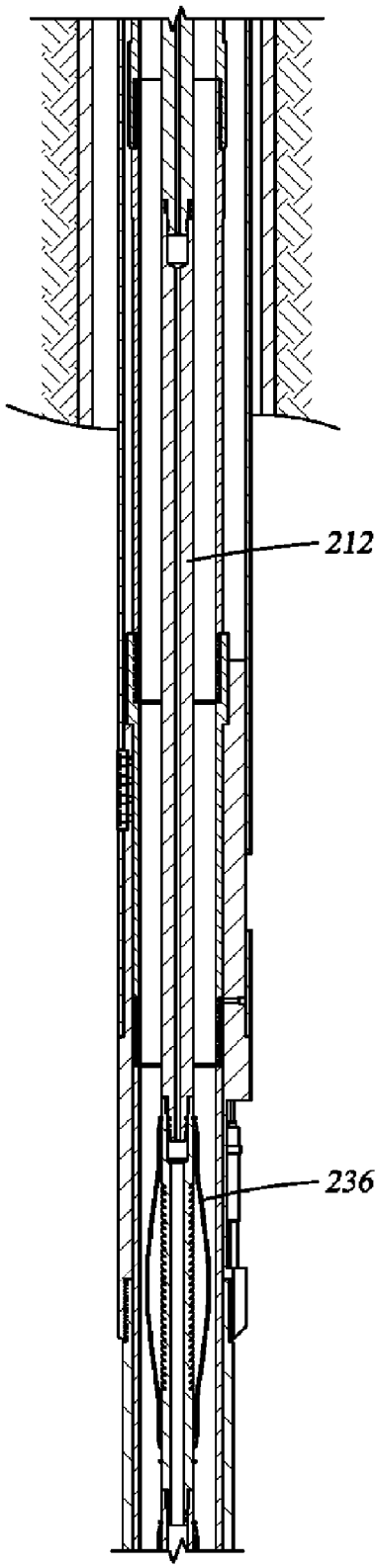
Figure 3B:
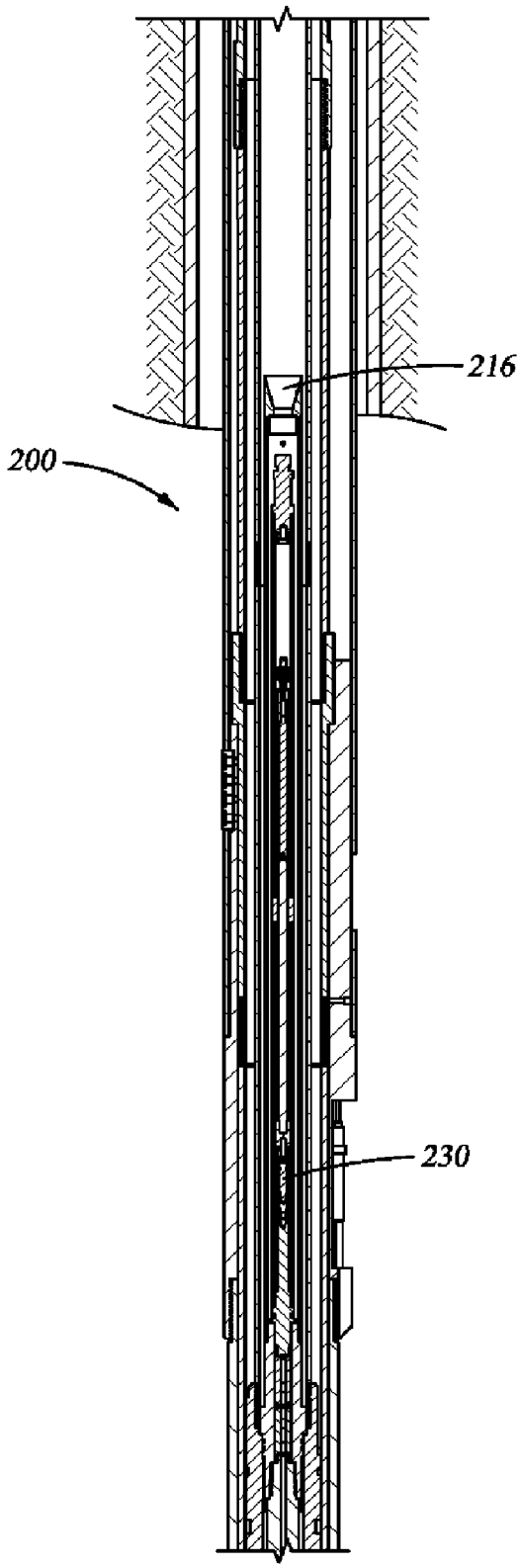
Figure 2C:
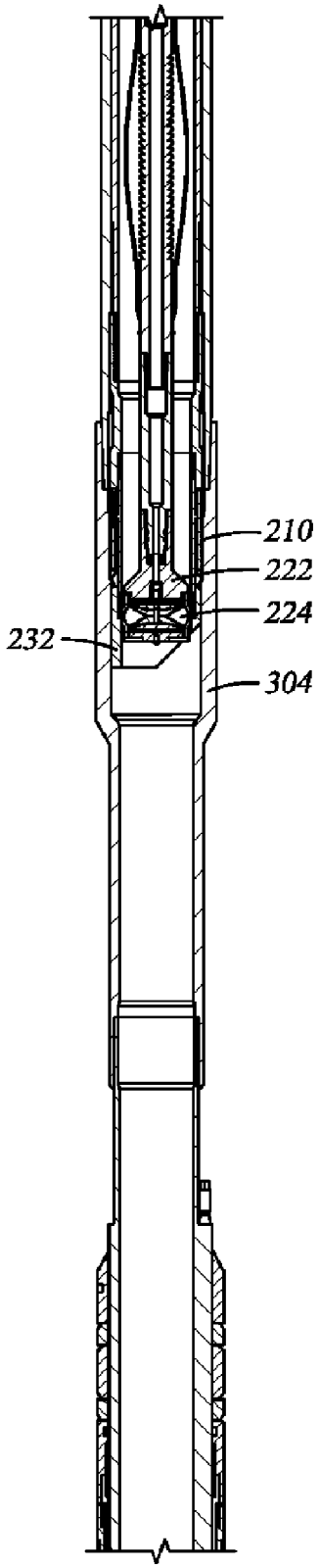
Figure 3C:
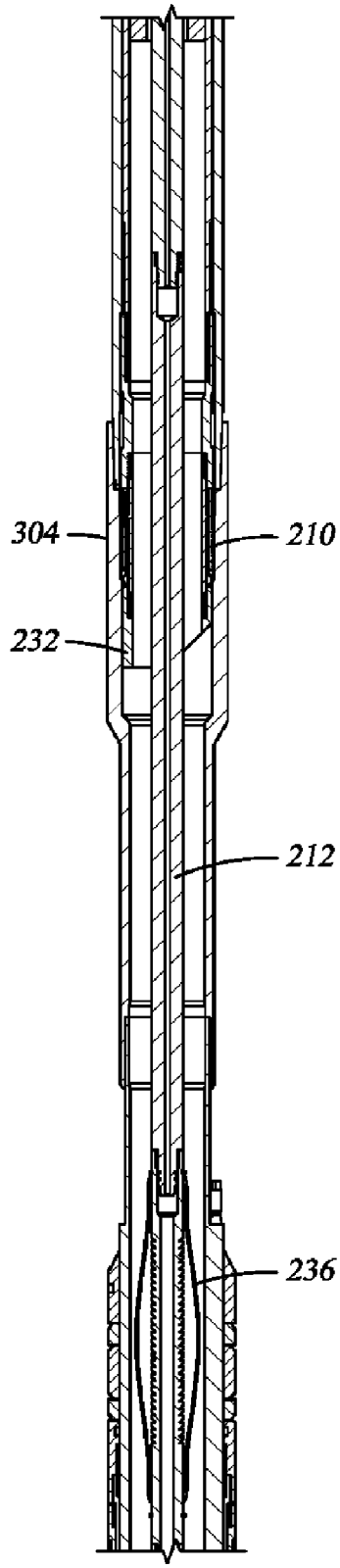
Figure 2D:
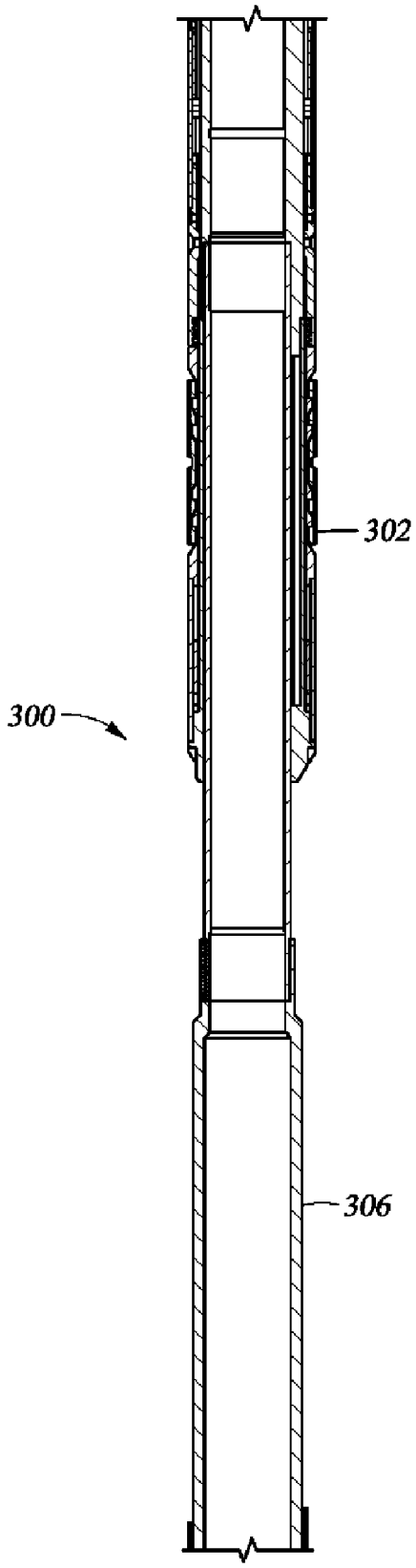
Figure 3D:
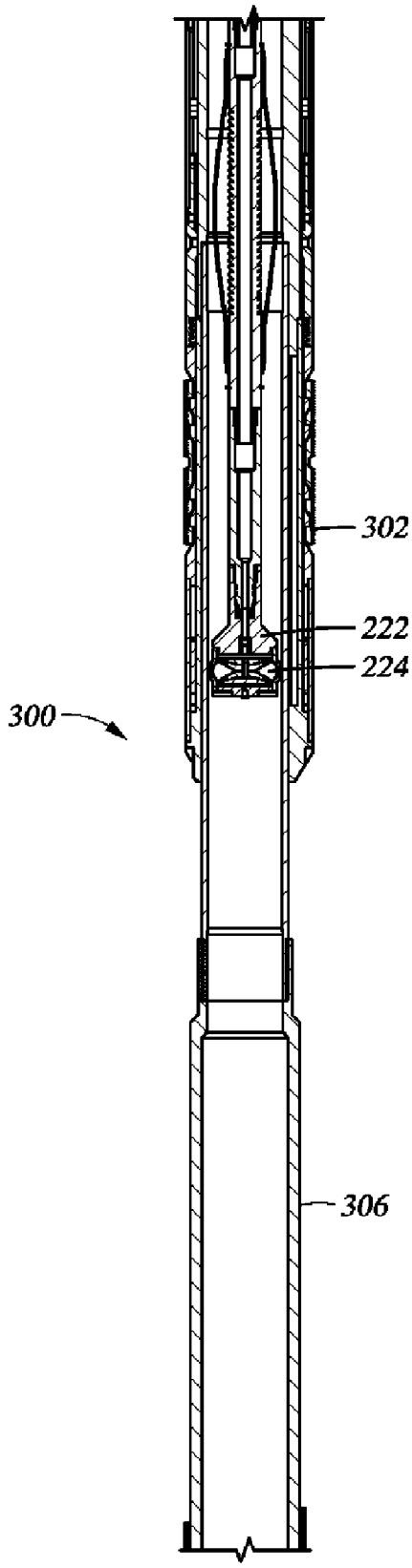
Figure 2E:
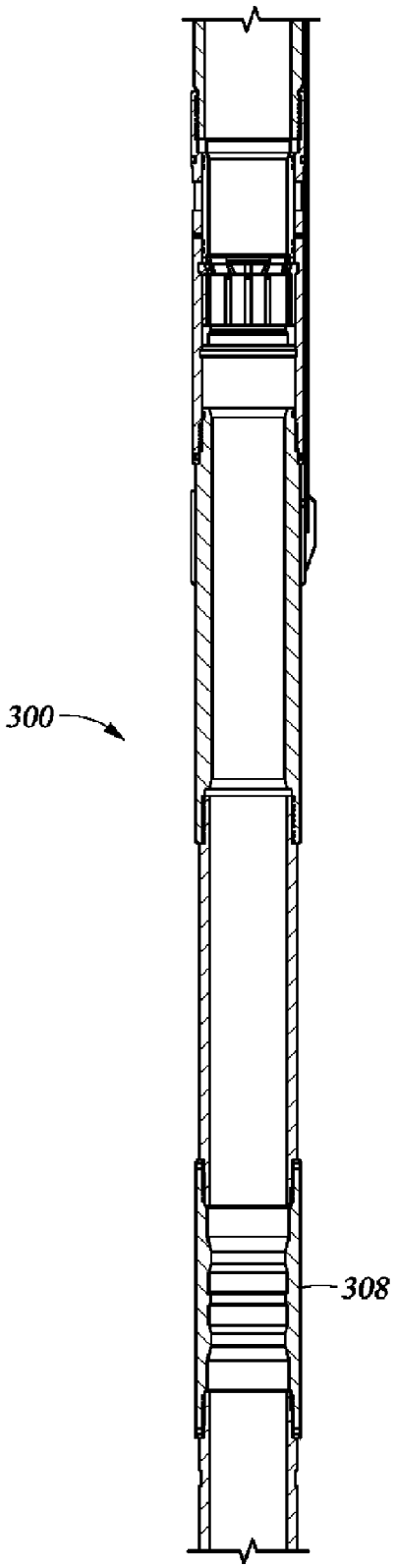
Figure 3E:
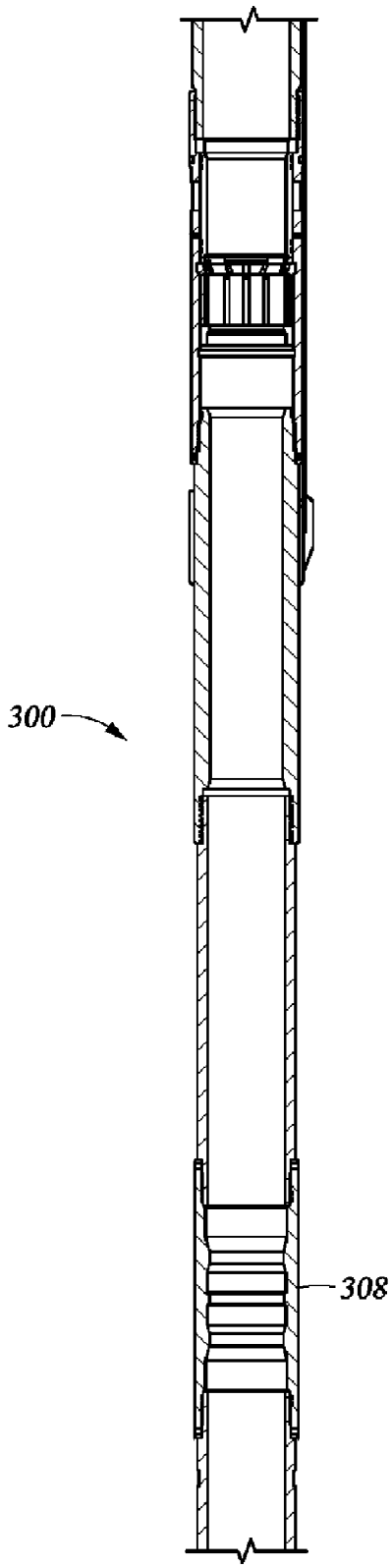

Referring now to FIGS. 2 and 3, a cut to release tool assembly 200 similar to that shown in FIG. 1 is shown engaged within a downhole anchor assembly 300. Downhole anchor assembly 300 includes a packer 302 located between an engagement profile 304 and a lower tubing assembly 306. Lower tubing assembly 306 optionally includes a latching profile 308 in which a lower retrieval device (not shown) of cut to release assembly 200 may be engaged. Furthermore, lower tubing assembly 306 can either include a string of downhole tools and equipment or can be absent altogether if packer 302 is the only component of anchor assembly 300 to be retrieved.

Referring specifically to FIG. 2, cut to release tool assembly 200 is shown in its retracted, as-delivered, configuration with cutter head 222 retracted within shroud 232 and thrust tubing 204 secured in its fully extended position relative to main body 206 by shear screws 218. In this configuration, cut to release assembly 200 is delivered to anchor assembly 300 and engagement adapter 210 of cut to release assembly 200 is engaged within engagement profile 304. Engagement adapter 210 can engage and lock within profile 304 through various methods including, but not limited to, ratchet profiles, threads, or any other type of engagement profile known in the art of downhole tools. Engagement adapter 210 is preferably constructed to be held by profile 304 with sufficient grip to support and retrieve entire anchor assembly 300 to be removed from the borehole. Alternatively, engagement adapter 210 can be configured to release from profile 304 under circumstances where cutter head 222 has detonated and packer 302 is not released. Such a configuration allows the retrieval and re-deployment of cut to release assembly 200 so that a second attempt at severing packer 302 can be made.

With engagement adapter 210 secured within profile 304, cut to release tool 200 is ready to be extended and activated. First, as with cut to release tool 100 of FIG. 1, thrust tubing 204 and coupling 202 are upwardly loaded in tension until shear screws 218 are ruptured. Once ruptured, downward axial compressive force is applied to move coupling 202, thrust tubing 204, activation tubing 212, and hydraulic firing head 222 into an extended position (FIG. 3).

Referring now to FIG. 3, cut to release tool assembly 200 is shown engaged within downhole anchor assembly 300 and in the extended, ready to activate, position. In the extended position, coupling 202 is hydraulically seated within sealing profile 242 of main body 206. Seals 244 and 246 hydraulically isolate a port 248 within coupling 202 so hydraulic fluids can no longer escape therethrough. Formerly, in the retracted position, pressure increases within bore of thrust tubing 204 and coupling 202 would be diverted through port 248 of coupling 202. This diversion prevents the premature activation of cutting head 222 by uncontrolled pressure increases or spikes. With cutting head 222 extended, premature activation is no longer as high of a concern. Bow springs 236 act to centralize cutting head 222 within the bore of packer 302 to prevent damage to cut to release assembly 200 and to ensure thorough cutting upon activation of cutting head 222.

Furthermore, the stroke, or length of displacement of thrust tubing 204 between retracted position (FIG. 2) and extended position (FIG. 3), is calculated to place cutting head 222 in exactly the location relative to packer 302 predicted to have the highest probability of severing packer 302 in a single firing. Cutting head 222 can be of any type of cutting head known by one skilled in downhole cutting operations including, but not limited to, shape charge detonation heads, chemical cutting heads, and mechanical cutting heads. Cutting head 222 of FIGS. 2 and 3 is a shape-charge cutting head, one that uses an explosive shape charge 224 to detonate and cut vital components of packer 302 in a predetermined pattern. Shape charge 224 is preferably configured such that packer 302 is severed but cut to release tool assembly 200 is unharmed. Furthermore, as shape charge 224 is preferably configured to detonate radially outward from cutting head 222, shape charge 224 can be configured as a 360° charge or a non 360° charge. A 360° charge is continuous in 360° around cutter head 222 and cuts a complete circle in packer 302 in one detonation. The benefit of the 360° charge is that the packer is typically completely severed immediately and no radial alignment with components of packer 302 is necessary to obtain a successful release. A drawback of the 360° charge is that absent further structure below cutter head 222, nothing remains to retain the lower tube assembly 306 if present. Therefore, in certain circumstances, a non-360° shape charge radially aligned at specific locations within packer can be used to sever packer 302 but still retain the ability to lift lower tube assembly 306 without further structure. Alternatively, a lower retainer (not shown) can be located below cutting head 222 of cut to release tool 200 for engagement with profile 308 to retain and lift lower tube assembly at the same time packer 302 is retrieved.

To detonate shape charge 224 of cutting head 222, pressure in the bore of thrust tube 204 is increased until an activation pressure is reached. With hydraulic port 248 of coupling 202 securely isolated within profile 242 of main body 206, increases in pressure in thrust tubing 204 result in increased pressures through hydraulic inlet 216 thereby acting upon detonation device 230. When sufficient pressure acts upon detonation device 230 for a sufficient amount of time, shape charge 224 is detonated and packer 302 is severed. Following severance, tension is applied to coupling 202 and thrust tubing 204 to retrieve cut to release tool assembly 200, packer 302, and the rest of downhole anchor assembly 300 in one return trip. If cutting head 222 is not successful in severing anchor components of packer 302, additional attempts can be made at deploying additional cutting heads 122 with new shape charges 124 thereon to make successive detonations.

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims.

What is claimed is:

1. An apparatus to cut and release a downhole anchor comprising:

a housing deployed upon a string of tubing in the wellbore, said housing including an engagement adapter at its distal end;

a cutter assembly in a recessed position within said distal end of the housing;

said engagement adapter corresponding with an engagement profile of the downhole anchor;

said cutter assembly configured to extend longitudinally from said recessed position to an extended position when said string of tubing is axially loaded;

said cutter assembly configured to cut and release the downhole anchor when activated in said extended position;

said engagement adapter being configured to retain the downhole anchor and retrieve it from said wellbore after said cutter assembly is activated; and wherein said cutter assembly is positioned below said housing when in said extended position.

2. The apparatus of claim 1, wherein said downhole anchor is a packer.

3. The apparatus of claim 1, wherein said string of tubing is drill pipe.

4. The apparatus of claim 1, wherein said string of tubing is coiled tubing.

5. The apparatus of claim 1, further including shear pins to secure said cutter assembly in said recessed position, said shear pins being configured to rupture and allow said cutter assembly to extend when said string of tubing is axially loaded.

6. The apparatus of claim 5, wherein said swing of tubing is axially loaded in tension.

7. The apparatus of claim 5, wherein said string of tubing is axially loaded in compression.

8. The apparatus of claim 1, wherein said cutter assembly includes an explosive charge to release the engaged downhole anchor.

9. The apparatus of claim 8, wherein said cutter assembly includes a detonator configured to detonate said charge when hydraulic pressure in said string of tubing is increased.

10. The apparatus of claim 1, wherein said cutter assembly includes a chemical cutter head.

11. The apparatus of claim 1, wherein said cutter assembly is retrievable from said housing.

12. The apparatus of claim 1, wherein said cutter assembly includes a bow spring to stabilize and bias said cutter assembly in position when activated.

13. The apparatus of claim 1, wherein said engagement adapter is a threaded adapter.

14. The apparatus of claim 1, wherein said engagement adapter is a ratcheting device.

15. A method to remove an anchor device from a wellbore comprising:

deploying a string of tubing down the wellbore to the anchor device, the string of tubing having a housing comprising an engagement adapter and a recessed cutter at a distal end thereof;

engaging the engagement adapter within an engagement profile of the anchor device;

extending the recessed cutter longitudinally below the housing;

activating the extended cutter;

cutting the anchor device with the activated cutter; and retrieving the string of tubing from the wellbore to remove the cut anchor device attached thereto.

16. The method of claim 15, further comprising axially loading the string of tubing to extend the recessed cutter.

17. The method of claim 15, further comprising increasing pressure in a bore of the string of tubing to activate the extended cutter.

18. The method of claim 15, further comprising cutting the anchor device with an explosive charge.

19. The method of claim 15, further comprising:

retrieving the cutter from the string of tubing;

deploying a second cutter though the string of tubing to the anchor device; and cutting the anchor device with the second cutter.

20. A cut and release tool to retrieve an engaged downhole anchor comprising:

a main body disposed at a distal end of a string of tubing disposed within a wellbore;

an explosive cutter recessed within said string of tubing and within said main body;

an engagement adapter connected to said main body and configured to securely engage with a corresponding profile of the downhole anchor;

said explosive cutter configured to longitudinally extend from a recessed position to an extended position when said string of tubing is axially loaded;

said explosive cutter being positioned below said main body when in said extended position;

said explosive cutter being configured to cut and release the downhole anchor when detonated; and said engagement adapter being configured to retain the downhole anchor and retrieve it from said wellbore after said explosive cutter is detonated.

21. The cut and release tool of claim 20, wherein the explosive cutter includes a shape charge device.

22. The cut ant release tool of claim 21, wherein said shape charge is a 360° shape charge.

23. The cut and release tool of claim 20, wherein said explosive cutter is retrievable from said string of tubing and the main body.

24. The cut and release tool of claim 20, further comprising a lower retainer to engage and retrieve components below the downhole anchor following detonation.

* * * * *